United States Patent [19]

Kuei

[11] Patent Number: 4,830,350

[45] Date of Patent: May 16, 1989

[54] UNIVERSAL CLAMPING DEVICE WITH MULTI-PURPOSE CLAMPING SURFACES

[76] Inventor: Andrew Kuei, No. 188-5, Kuang, Ming Road, Taichung, Taiwan

[21] Appl. No.: 121,048

[22] Filed: Nov. 16, 1987

[51] Int. Cl.[4] ..... B25B 5/16

[52] U.S. Cl. ..... 269/279; 269/271

[58] Field of Search ..... 269/271, 277, 279

[56] References Cited

U.S. PATENT DOCUMENTS 2,938,414 5/1960 Blomme ..... 269/279

*Primary Examiner*—Gene Wan

*Attorney, Agent, or Firm*—Holman & Stern

[57] ABSTRACT

The present invention relates to an universal clamping device with multi-purpose clamping surfaces, it is composed of a jaw and one or more jaw seats. Wherein the jaw comprises a plurality of vertical jaw seats and each of said jaw seat comprises a vertical curve wall and a horizontal bottom base, said vertical curve wall comprises an extension rib parallel to the bottom base, said horizontal bottom base comprises a piercing hole whch is relatively in the center of the extension rib. The jaw plate has various different vertical clamping surfaces, it comprises peripherally a ring groove corresponding to said extension rib and has a vertical bottom hole corresponding to the piercing hole of said jaw, the maximum radius of gyration of the jaw plate is smaller than the radius of the curve of vertical wall. A locating device comprises at least one locating pin to insert into both said vertical hole and said piercing hole so that the jaw plate can take the locating pin as an axial center to make rotation on the top of said jaw to change different clamping surface. Furthermore, the locating device has a compensation design to reduce the occurrence of inclination of bellmouth due to long period of performance in clamping work.

12 Claims, 4 Drawing Sheets

UNIVERSAL CLAMPING DEVICE WITH MULTI-PURPOSE CLAMPING SURFACES

BACKGROUND OF THE INVENTION

The present invention relates to one kind of clamping device, especially can be applied to vice or similar clamping tools, comprising multi-purpose clamping surfaces.

According to prevailing technology, regular claimping device such as vice and etc., is to firmly fix a jaw plate by screw onto relative wall surface of a steady jaw; in this kind of simple design, jaw plate has only one clamping surface which in practice, can not satisfy the work of clamping material in various shapes or different materials; in order to solve this problem, the changeable jaw plates have been developed for the selection of different clamping surfaces, however this kind of design is not well accepted because of the inconvenience in operation.

Furthermore, any type of regular jaw and jaw plate undertakes a certain extent of reactive force while clamping. Therefore, after long time of performance, an inclination of bellmouth occurs on the jaw and the clamping surface of the jaw plate and make it cannot be kept in squareness to perform its work in high precision.

SUMMARY OF THE INVENTION

The major object of the invention is to provide an universal clamping device with multi-purpose clamping surfaces. Basically every piece of jaw plate comprises various different clamping surfaces so that the jaw plate needs not to be replaced while selecting a proper clamping surface.

Another object of the invention is the provision of an universal clamping device with multi-purpose clamping surfaces, wherein the change of clamping surface does not need to remove jaw from vise or other clamping devices and its operation is very simple.

A yet further object of the invention is to provide an universal clamping device with multi-purpose clamping surfaces, wherein a compensation design can reduce the occurrence of bellmouth on clamping surface.

According to the universal clamping device with multi-purpose clamping surfcaces of the prersent invention, it comprises:

A jaw that comprises at least one or more vertical jaw seat, the vertical jaw seat comprises a vertical curve wall and a horizontal bottom base, said vertical curve wall has an extension rib with curve in the center and is parallel to the bottom base, said bottom base has a piercing hole which is relatively in the center of said extension rib.

The same numbers of jaw plates to the vertical jaw seats have at least two different vertical clamping sarfaces, said jaw plate has a ring groove to form as a cylindrical part, when said jaw plate is connected with a respective vertical jaw seat by scarf joint between said ring groove and said extension rib, the peripheral surface of said cylindrical part is closely in contact with the peripheral surface of said extension rib, said jaw plate has a vertical hole to match in the center of the hole on said bottom base, with the locating device in connection with said two holes the jaw plate can turn freely on above the bottom base and change different clamping surface.

The same numbers of locating devices to the vertical jaw seats are composed of at least a locating pin with both ends respectively inserted into the piercing hole of said bottom base and the vertical hole of said jaw plate so that the jaw plate can take the locating pin as an axial center to turn on above said bottom base.

The universal clamping device with multi-purpose clamping surfaces of the present invention is also characterized in that:

Said locating device is a round pin with two steps in different diameters, the pin is located in both holes of said jaw and said jaw plate, it can only move axialy up and down but not turn, the upper part of said pin with bigger diameter is located in the vertical hole of said jaw plate and has a threaded hole on top of it, the lower part of said pin with smaller diameter is located in the piercing hole of said bottom base.

On the top surface of said jaw plate, there is another hole joint through the vertical hole, an adjusting screw is located here on the top surface of said jaw plate to connect with the pin, the adjusting screw can turn to move the pin axialy to get upward and downward movements, because of the movements, it create different supporting point while clamping, this will offset the force which create the inclination of bellmouth.

BRIEF DESCRIPTION OF THE DRAWINGS

This invention will be more fully understood from the following detailed description, taken in connection with the accompanying drawing which form an integral part of this application and in which.

DETAILED DESCRIPTION OF THE PREFERRED EMBODIMENTS

Figure 1A:
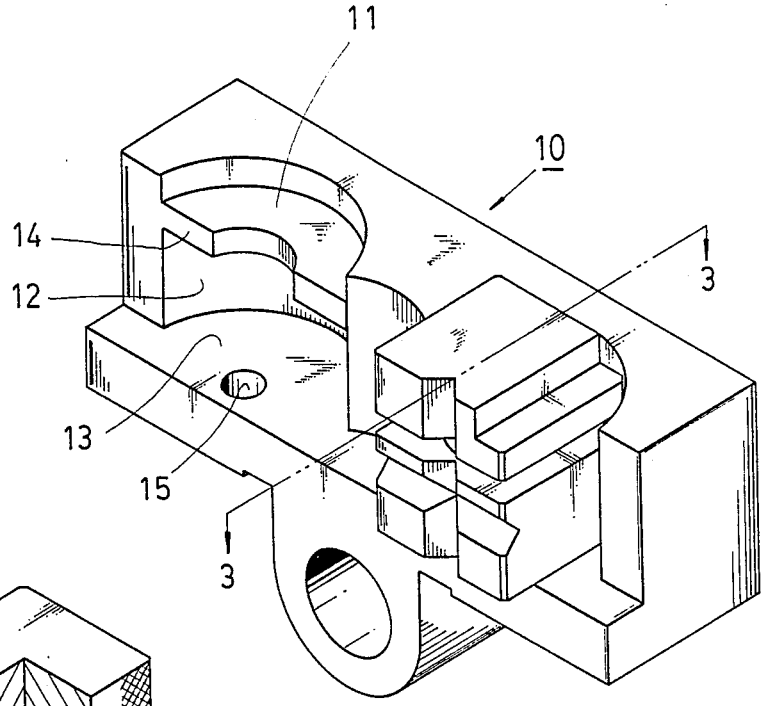
FIG. 1A is a perspective view of an universal clamping device with multi-purpose clamping surfaces in accordance with one preferred embodiment of this invention.
Figure 1B:
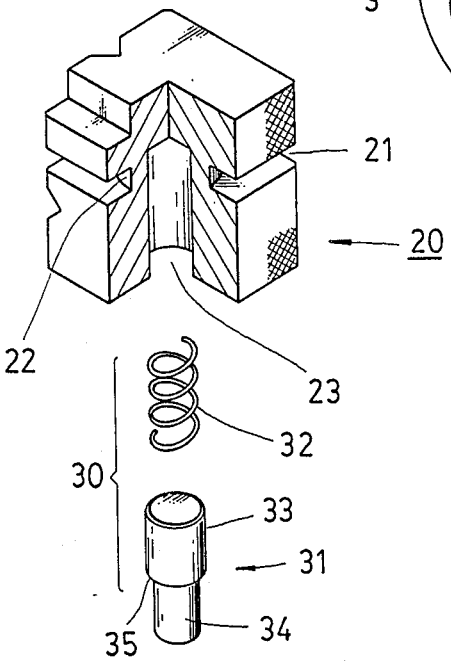
FIG. 1B is an exploded perspective view, part broken away, of a jaw plate.
Figure 2A:
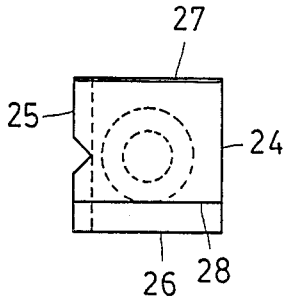
FIG. 2A is a plan view of the jaw plate.
Figure 2B:
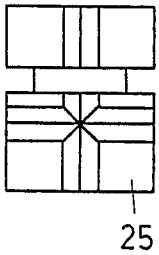
FIGS. 2B–2E are elevational views of the jaw plate from its respective sides.
Figure 2C:
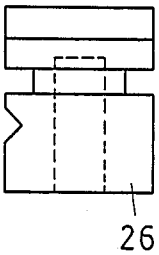
Figure 2D:
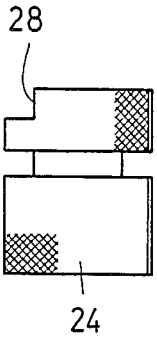
Figure 2E:
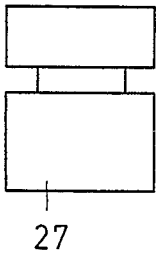

In the first preferred embodiment of the invention as shown in FIG. 1 through FIG. 4, a jaw 10 comprises two separate vertical jaw seats 11 from the top surface of jaw downward to the bottom base 13. the vertical jaw seat 11 comprises a vertical curve wall 12 and horizontal bottom base 13. On the vertical curve wall 13, there is an extension rib 14 parallel to the bottom base 13. On the bottom base 13, there is provided with a piercing hole 15 and the hole 15 itself is relatively in the center of the extension rib 14.

Two pieces of jaw plate 20 are respectively placed in each vertical jaw seat 11 of said jaw 10. The jaw plate 20 is a rectangular body comprising a ring groove 21 around its peripheral surface to form as a cylindrical part 22. When placing each jaw plate 20 to a respective vertical jaw seat 11 by scarfing said ring groove 21 and said extension rib, the peripheral surface of said cylindrical part 22 closely contacts with the peripheral surface of said extension rib 14, wherein the center of the bottom of said jaw plate 20 has a vertical hole 23 corresponding to the piercing hole 15 of said vertical jaw seat 11, and the half length of the maximum diagonal of any horizontal surface of said jaw plate R1 (i.e. maximum radius of gyration) is shorter than the radius of curvature R2 of the vertical curve wall 12 of said vertical jaw seat 11.

The four vertical surfaces of said jaw plate 20 comprising respective clamping surface, as shown in FIG. 2, wherein the first clamping surface 24 is a knurled surface for a clamping work of heavy loading; the second clamping surface 25 comprises horizontal and vertical V-shaped grooves for better clamping of round bars or tubes; the third clamping surface 26 is hardened and ground for light loading work; the fourth clamping surface 27 has a soft material such as copper or aluminum firmly fixed thereonto for clamping soft materials; the fifth clamping surface 28 is a step formed by cutting the contact point between the top surface and the third clamping surface 26 to facilitate a clamping work for drilling so as to prevent demage the body of the clamping device.

Two locating devices 30, each is composed of one locating pin 31 and one spring 32 to locate said jaw plate 20 on respective vertical jaw seat 11. The locating pin 31 is a two steps round pin, the upper part 33 of which is bigger in diameter and just can insert into the vertical hole 23 of the jaw plate 20, the lower part 34 of which is smaller in diameter and just can inser into the piercing hole 15 of the vertical jaw seat 11. The locating pin 31 comprises a cone surface 35 at the contact point between the upper part 33 and the lower part 34 to reduce the damage of the concentration of stress. The spring 32 is placed into the vertical hole 23 of the jaw plate 20 and compressed between the top wall of the vertical hole 23 and the top surface of the locating pin 31 to provide a proper locking force by means of its release force.

Figure 3:
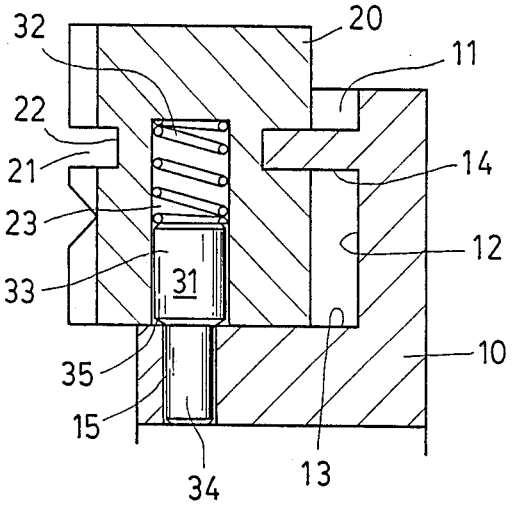
FIG. 3 is a cross-sectional view taken along line 3—3 of FIG. 1.

While in assembling, as shown in FIG. 3, place the spring 32 and the locating pin 31 into the vertical hole 23 of said jaw plate 20 in proper sequence, press the jaw plate downward onto the bottom base 13 of the vertical jaw seat 11 and let the locating pin 31 draw back inside the vertical hole 23, then, move the jaw plate 20 horizontally against the ring groove 21 and the extension rib 14 each other, when reaching the locating pin 31 to the piercing hole 15, the lower part 34 of said locating pin 31 will insert into the piercing hole 15. Because of the scarf joint between said ring groove 21 and said extension rib 14 and the joint between said locating pin 31 and said piercing hole 15, the jaw plate 20 is seized horizontally and vertically and firmly located on said vertical jaw seat 11.

When to disassemble, use a round bar to push the locating pin 31 upward from the piercing hole 15 to let the lower part 34 of said locating pin 31 slip away from the piercing hole 15, then remove the jaw plate 20 horizontally in reverse direction to separate the jaw plate 20 from said vertical jaw seat 11.

To change clamping surface while in use, it is not necessary to remove the jaw plate. Please refer to FIG. 4, matching with FIG. 3, the jaw plate 20 is located on said vertical jaw seat 11 and can make a turn relative to the vertical jaw seat 11, and further, the maximum radius of gyration of the jaw plate 20 is shorter than the radius of curvature of vertical curve wall 12 of the vertical jaw seat 11, therefore, to grasp the jaw plate 20 and make a turn of it, then it will be turned around based on the locating pin 31 as an axial center, every turn of an interval of 90 can make a change of another clamping surface to clamp work piece of different shape or material.

Figure 6:
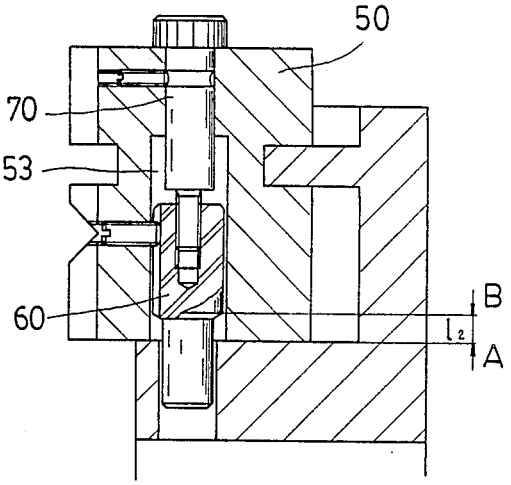
FIG. 6 is similar to FIG. 5, illustrating the change of position of a locating pin relative to the jaw plate.
Figure 5:
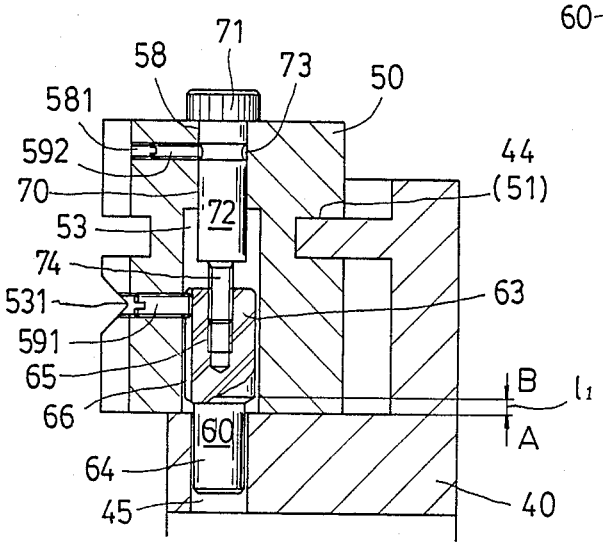
FIG. 5 is a cross-sectional view of a second preferred embodiment.
Figure 4:
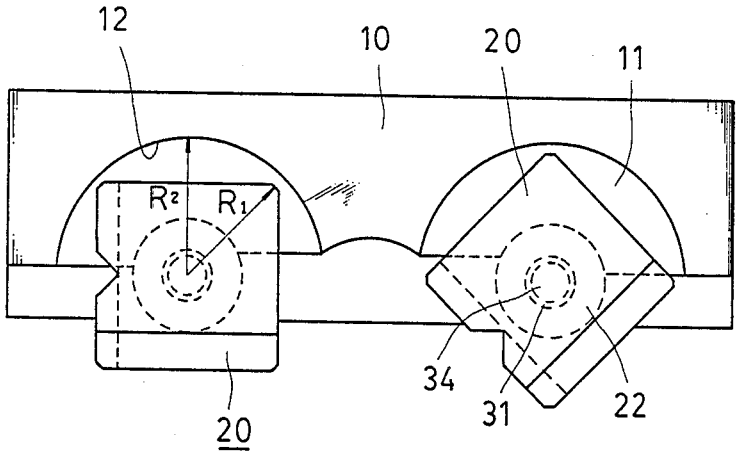
FIG. 4 is a top view taken from FIG. 1, showing the change of clamping surface in motion.

Please refer to the second preferred embodiment as shown in FIG. 5 and FIG. 6, wherein the basic structure of jaw 40 is same as the jaw 10 in the first embodiment; the jaw plate 50, in addition to a structure same as the jaw plate 20 in the first preferred embodiment, comprises a pivot hole 58 on the top surface to joint with the vertical hole 53. On the second clamping surface of said jaw plate 50, there are two threaded holes 531. 581 inside the V-shaped grooves to joint with the vertical hole 53 and the pivot hole 58; the locating pin 60 comprises a threaded hole 65 on its top surface and an axial groove 66 on its periphery with the rest part in same structure as the locating pin 30 in the first preferred embodiment; the locating pin 60 in the second preferred embodiment does not use spring that used in the first preferred embodiment, instead with two locating screws 591 592 and one adjusting screw 70 are placed respectively into said threaded holes 531 581 and pivot hole 58, the locating screw 591 is inserted into the axial groove 66 of said locating pin 60 and the locating pin 60 can only make an axial movement against the vertical hole 53 of said jaw plate 50 but not a pivot movement; the adjusting screw is composed of a nut 71, a bolt 72, a ring groove 73 and a screw 74, wherein the bolt (72) is inserted into the pivot hole (58) of the jaw plate (50), the nut (71) acts as a damper and can be grasped to turn, the ring groove (73) is aimed at bolt hole (581) for locating screw (592) to insert thereinto so as to keep the adjusting screw (70) making a rotation in original place against the jaw plate (50), the screw (74) is screwed into the bolt hole (65) of the locating pin (60).

In addition to the function of multi-purpose clamping surface of the first preferred embodiment, the design of the second preferred embodiment as shown in FIG. 5, has another feature: when the jaw is in motion, the reactive force is pressed on the left side of the jaw plate (50) and the jaw plate (50) transmits the force to the locating pin (60), because the upper part (63) and the lower part (64) of the locating pin (60) are respectively inserted into the the vertical hole (53) of the jaw plate (50) and the piercing hole (45) of the jaw (40) leaving respective clearance therein (usually 0.02 mm–0.05 mm), therefore, assuming that the topmost contact point between the lower part (64) and the piercing hole (45) is support point A, the lowest contact point between the upper part (63) and the vertical hole (53) is force point B, when the locating pin (60) transmits a force to the right side of the jaw plate (50) and to the wall of the piercing hole (45), a moment of force is occured, said moment of force makes the lower part of the jaw plate (50) below the scarf joint between the ring groove (51) and the extension rib (44) to move backward, and because of the clearance between said ring groove (51) and said extension rib (44), the part of the jaw plate (50) that below said ring groove (51) moves backward for a micro distance, this micro move can drastically improve the problem of the occurrence of bellmouth in jaw due to long period of performance.

Normally the occurrence of bellmouth is in direct proportion to the closing force of clamping, therefore, in order to properly compensate while in different loading of clamping, the arm of force between the force point B and the support point A is designed to be adjustable; as shown in FIG. 6, when turning the adjusting screw 70 the locating pin 60 is moved along the vertical hole 53, the point A (it is also the upper edge of the hole 45) is not changed and the relative position of the force point B (it is also the bottom line of the upper part 63 of said locating pin 60) is moved against the vertical hole 53, and the arm of force between the point A and the point B is adjusted, therefore, different arm of force under same applied force produces different moment of force and relatively the backward tendency of said jaw plate 50 is different. Therefore, the bigger the moment of force, the more compensation; the smaller the moment of force, the less compensation, user can make a proper adjustment.

Figure 7:
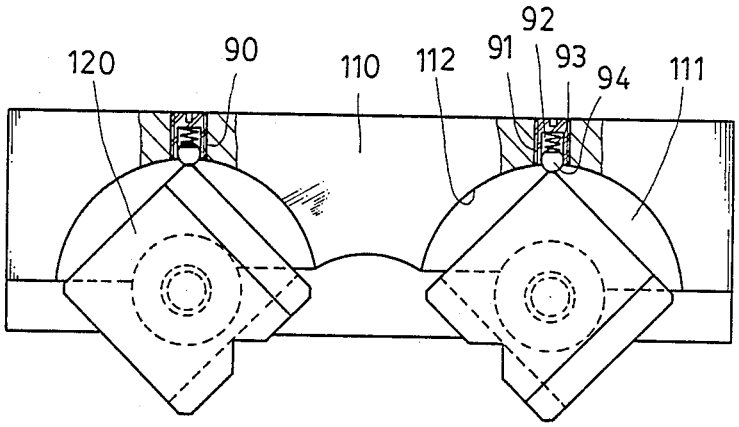
FIG. 7 is a third preferred embodiment similar to FIG. 4, illustrating an positioning device on the jaw.

Please refer to the third preferred embodiment as shown in FIG. 7. A jaw 110 comprises two positioning devices 90 on the back side relative to the center of the vertical jaw seats 111. Each of the positioning device 90 comprises a socket 91; the socket 91 comprises externally a thread to connect with said jaw 110 by screw joint, and also comprises axially a seat 92 for a spring 93 and a steel ball 94 to place thereinto; the spring 93 and the steel ball 94 can draw back into the seat 92 but will not slip away; the steel ball is exposed outside of the vertical curve wall 112 of said vertical jaw seat 111; when a clamping surface of the jaw plate 120 is turned to an angle of 45 to fit special clamping work, by means of the support of said steel ball 94 to a proper periphery of the jaw plate 120, the jaw plate 120 is stably positioned.

In the above-mentioned three preferred embodiments, no matter the locating pin is relatively movable or immovably connected with the vertical hole of the jaw plate, basically the jaw plate can turn to change different clamping surface by using the locating pin and the hole of jaw. In addition, the present invention has other features such as simple in operation, free from the inconvenience of storing different pieces of jaw plate, reduction in the occurrence of bellmouth in jaw.

What is claimed is:

1. A clamping jaw structure comprising a jaw housing provided with at least one clamping assembly, the clamping assembly comprising means on the housing defining a jaw seat, and an adjustable jaw mounted on the seat, the seat including a base wall, a part-cylindrical peripheral wall extending upwardly from the base wall, a part ring-shaped rib extending inwardly from the peripheral wall, and a first bore in the base wall substantially coaxially disposed with respect to the peripheral wall and rib, the jaw comprising a prismatic body having at least two angularly related clamping faces, a peripheral groove in the clamping body received on said rib and an axial second bore in the clamping body aligned with said first bore, the structure further including a pin received in the respective bores for rotationally mounting the jaw on the seat and enabling said clamping faces to be selectively presented to a workpiece by rotational adjustment of the jaw on the seat.

2. A structure as defined in claim 1, including two of said clamping assemblies locates side by side on the jaw housing.

3. A structure as defined in claim 1, wherein the first bore has a smaller diameter than the second bore and wherein the pin has upper and lower stepped portions with respective diameters fitting in the respective bores.

4. A structure as defined in claim 3 including a pressure spring located in the second bore for providing downward pressure on the pin.

5. A structure as defined in claim 3, including means in said jaw for constraining said pin to move axially in the second bore, an adjustment rod extending into the second bore from an upper surface of the jaw, a threaded connection between the rod and the pin, and means in the jaw constraining the rod for rotation in the second bore whereby rotation of the rod effects axial movement of the pin.

6. A structure as defined in claim 5, wherein the rod has an adjustment knob on said upper surface.

7. A structure as defined in claim 5, wherein the means for constraining the pin comprises a first lateral plug in the jaw having an inner end engaging in a longitudinal groove in the pin, and wherein the means for constraining the rod comprises a second lateral plug in the jaw having an inner end engaging in the circumferential groove in the rod.

8. A structure as defined in claim 1, including spring detent means on the peripheral wall of the seat for engaging the jaw and retaining same in selected angular positions.

9. A structure as defined in claim 1, wherein the jaw has a first clamping face which is knurled and a second clamping face formed with crossing grooves.

10. A structure as defined in claim 9, wherein the jaw has a third clamping face which is hardened and ground.

11. A structure as defined in claim 10, wherein the jaw has a fourth clamping face with a soft material affixed thereto.

12. A structure as defined in claim 11, wherein the jaw has a fifth clamping face of stepped configuration between a top surface of the jaw and the third clamping face.

* * * * *